US010253389B2

(12) United States Patent
Takashima et al.

(10) Patent No.: US 10,253,389 B2
(45) Date of Patent: Apr. 9, 2019

(54) HIGH-YIELD-RATIO, HIGH-STRENGTH COLD-ROLLED STEEL SHEET AND PRODUCTION METHOD THEREFOR

(71) Applicant: JFE Steel Corporation, Tokyo (JP)

(72) Inventors: Katsutoshi Takashima, Chiba (JP); Kohei Hasegawa, Tokyo (JP)

(73) Assignee: JFE Steel Corporation (JP)

( * ) Notice: Subject to any disclaimer, the term of this patent is extended or adjusted under 35 U.S.C. 154(b) by 244 days.

(21) Appl. No.: 15/128,516

(22) PCT Filed: Mar. 17, 2015

(86) PCT No.: PCT/JP2015/001455
§ 371 (c)(1),
(2) Date: Sep. 23, 2016

(87) PCT Pub. No.: WO2015/151427
PCT Pub. Date: Oct. 8, 2015

(65) Prior Publication Data

US 2017/0107591 A1 Apr. 20, 2017

(30) Foreign Application Priority Data

Mar. 31, 2014 (JP) ..... 2014-073268

(51) Int. Cl.

| | |
|---|---|
| ***C21D 9/46*** | (2006.01) |
| ***C21D 1/25*** | (2006.01) |
| ***C21D 8/02*** | (2006.01) |
| ***C21D 8/04*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/38*** | (2006.01) |
| ***C22C 38/58*** | (2006.01) |
| ***C22C 38/00*** | (2006.01) |
| ***C23G 1/00*** | (2006.01) |

(52) U.S. Cl.

CPC ..... *C21D 9/46* (2013.01); *C21D 8/0226* (2013.01); *C21D 8/0236* (2013.01); *C21D 8/0263* (2013.01); *C21D 8/0273* (2013.01); *C21D 8/0278* (2013.01); *C21D 8/0473* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/38* (2013.01); *C22C 38/58* (2013.01); *C23G 1/00* (2013.01); *C21D 1/25* (2013.01); *C21D 2211/001* (2013.01); *C21D 2211/002* (2013.01); *C21D 2211/005* (2013.01); *C21D 2211/008* (2013.01)

(58) Field of Classification Search

CPC ... C22C 38/001; C22C 38/002; C22C 38/005; C22C 38/02; C22C 38/04; C22C 38/06; C22C 38/08; C22C 38/12; C22C 38/14; C22C 38/16; C22C 38/28; C22C 38/38; C22C 38/58; C21D 1/25; C21D 8/0226; C21D 8/0236; C21D 8/0263; C21D 8/0273; C21D 8/0278; C21D 8/0473; C21D 9/46; C21D 2211/001; C21D 2211/002; C21D 2211/005; C21D 2211/008

USPC ..... 420/83, 93, 118, 120, 126, 128; 148/652

See application file for complete search history.

(56) References Cited

U.S. PATENT DOCUMENTS

| | | | | |
|---|---|---|---|---|
| 8,951,366 | B2 * | 2/2015 | Sano | C22C 38/02 148/652 |
| 2013/0087257 | A1 * | 4/2013 | Yoshino | C21D 9/46 148/648 |

(Continued)

FOREIGN PATENT DOCUMENTS

| | | |
|---|---|---|
| CN | 103476960 | 12/2013 |
| EP | 1 365 037 | 11/2003 |

(Continued)

OTHER PUBLICATIONS

English translation of JP 2010/059452, Mar. 2010; 21 pages.*

(Continued)

*Primary Examiner* — Helene Klemanski
(74) *Attorney, Agent, or Firm* — DLA Piper LLP (US)

(57) ABSTRACT

A high-yield-ratio, high-strength cold-rolled steel sheet has a composition containing, in terms of % by mass, C: 0.13% to 0.25%, Si: 1.2% to 2.2%, Mn: 2.0% to 3.2%, P: 0.08% or less, S: 0.005% or less, Al: 0.01% to 0.08%, N: 0.008% or less, Ti: 0.055% to 0.130%, and the balance being Fe and unavoidable impurities. The steel sheet has a microstructure that contains 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite, and the bainite and the tempered martensite having an average crystal grain diameter of 5 μm or less.

16 Claims, No Drawings

(56) References Cited

U.S. PATENT DOCUMENTS

| | | | | |
|---|---|---|---|---|
| 2013/0312433 | A1 | 11/2013 | Nemit, Jr. | |
| 2014/0000765 | A1 | 1/2014 | Nozaki et al. | |
| 2014/0044988 | A1 | 2/2014 | Futamura et al. | |
| 2014/0227555 | A1* | 8/2014 | Kawata | C22C 38/06 428/659 |
| 2014/0377584 | A1* | 12/2014 | Hasegawa | C22C 38/14 428/659 |
| 2015/0184274 | A1 | 7/2015 | Kakiuchi et al. | |
| 2016/0177414 | A1 | 6/2016 | Takashima et al. | |
| 2016/0369369 | A1* | 12/2016 | Takashima | C21D 9/46 |
| 2017/0145534 | A1* | 5/2017 | Takashima | C21D 8/0226 |

FOREIGN PATENT DOCUMENTS

| | | | |
|---|---|---|---|
| EP | 2 692 893 | A1 | 2/2014 |
| JP | 2001-011565 | | 1/2001 |
| JP | 2004-332099 | A | 11/2004 |
| JP | 2005-240178 | A | 9/2005 |
| JP | 2010-18862 | A | 1/2010 |
| JP | 2010/059452 | * | 3/2010 |
| JP | 2011-52295 | A | 3/2011 |
| JP | 2011-144404 | | 7/2011 |
| JP | 2012-041611 | | 3/2012 |
| JP | 2012-214869 | A | 11/2012 |
| JP | 2014-19879 | A | 2/2014 |
| JP | 2015-34327 | A | 2/2015 |

OTHER PUBLICATIONS

English translation of JP 2011/144404, Jul. 2011; 15 pages.*

"X-ray Diffraction Handbook", Rigaku Denki Co., Ltd., 2000, pp. 26 and 62-64 along with a partial English translation.

Chinese Office Action dated May 5, 2017, of corresponding Chinese Application No. 201580017800.7, along with a Patent Search Report in English.

Extended European Search Report dated Mar. 17, 2017, of corresponding European Application No. 15772325.5.

Japanese Office Action dated Oct. 13, 2015, of corresponding Japanese Application No. 2015-536706, along with a Concise Statement of Relevance of Office Action in English.

* cited by examiner

HIGH-YIELD-RATIO, HIGH-STRENGTH COLD-ROLLED STEEL SHEET AND PRODUCTION METHOD THEREFOR

TECHNICAL FIELD

This disclosure relates to high-strength cold-rolled steel sheets having high yield ratios and production methods therefor, particularly, to a high-yield-ratio, high-strength cold-rolled steel sheet suitable for use in parts of structural components of automobiles and the like.

BACKGROUND

In recent years, $CO_2$ emission regulation has become tighter due to increasing environmental concerns. In the field of automobiles, weight reduction of car bodies has emerged as a challenge in improving fuel efficiency. Under such trends, automobile parts have become increasingly thinner by the use of high-strength steel sheets. In particular, high-strength cold-rolled steel sheets having a tensile strength (TS) of 1180 MPa or higher are now being increasingly used.

High-strength steel sheets used in structural parts and reinforcing parts of automobiles are required to have excellent formability. In particular, high-strength steel sheets used in parts having complicated shapes are required to excel in not only one but both of elongation and stretch flangeability (hereinafter may also be referred to as hole expandability). Moreover, automobile parts such as structural parts and reinforcing parts are required to have excellent impact energy absorbing properties. It is effective to improve the yield ratio of the steel sheets used as a raw material to improve the impact energy absorbing property of automobile parts. Automobile parts that use high-yield-ratio steel sheets can efficiently absorb impact energy despite low strain. The yield ratio (YR) is the value of the ratio of the yield stress (YS) to the tensile strength (TS) and is represented by YR=YS/TS. A steel sheet having a TS of 1180 MPa or more may undergo delayed fracture (hydrogen embrittlement) due to hydrogen from the working environment. Thus, to use a high-strength steel sheet having a TS of 1180 MPa or more, high press formability and excellent delayed fracture resistance are required.

Dual phase steel (DP steel) having a ferrite-martensite microstructure are known as high-strength steel sheets having both formability and high strength. For example, Japanese Unexamined Patent Application Publication No. 2011-052295 discloses a high-strength cold-rolled steel sheet having a good balance between elongation and stretch flangeability. This steel sheet has a particular composition and a microstructure containing an area ratio of 70% or more (including 100%) of tempered martensite having a hardness of higher than 380 Hv and 450 Hv or less and ferrite constituting the rest of the microstructure. The distribution of cementite grains in the tempered martensite is such that 20 or more cementite grains having an equivalent circle diameter of 0.02 μm or more and less than 0.1 μm are present per square micrometer of the tempered martensite, and 1.5 or fewer cementite grains having an equivalent circle diameter of 0.1 μm or more are present per square micrometer of the tempered martensite. Japanese Unexamined Patent Application Publication No. 2011-052295 describes that when the hardness and area ratio of the tempered martensite and the cementite grain distribution in the tempered martensite are appropriately controlled in the dual phase microstructure composed of ferrite and tempered martensite, the balance between the elongation and stretch flangeability can be maintained while improving tensile strength.

Japanese Unexamined Patent Application Publication No. 2010-018862 discloses a high-strength cold-rolled steel sheet as a steel sheet having excellent workability and delayed fracture resistance. This steel sheet has a particular composition containing V: 0.001 to 1.00% and has a microstructure containing tempered martensite in an area ratio of 50% or more (including 100%) and ferrite constituting the rest of the microstructure. The distribution of precipitates in the tempered martensite is such that 20 or more precipitates having an equivalent circle diameter of 1 to 10 nm are present per square micrometer of the tempered martensite, and 10 or fewer V-containing precipitates having an equivalent circle diameter of 20 nm or more are present per square micrometer of the tempered martensite. Japanese Unexamined Patent Application Publication No. 2010-018862 describes that when a tempered martensite single phase microstructure or a dual phase microstructure composed of ferrite and tempered martensite has an appropriately controlled tempered martensite area ratio and an appropriately controlled distribution of V-containing precipitates precipitating in the tempered martensite, stretch flangeability is improved while ensuring hydrogen embrittlement resistance.

An example of a steel sheet that has both high strength and excellent ductility is a TRIP steel sheet that utilizes transformation induced plasticity (TRIP) of retained austenite. The TRIP steel sheet has a steel sheet microstructure containing retained austenite. When the TRIP steel sheet is worked and deformed at a temperature of the martensite transformation start temperature or more, retained austenite is induced by stress to transform into martensite and large elongation is obtained. However, the TRIP steel sheet has a drawback in that because retained austenite transforms into martensite during blanking, cracks occur at the interface with ferrite and hole expandability is degraded. Thus, high-strength steel sheets having excellent ductility and hole expandability (stretch flangeability) have been developed as disclosed in Japanese Unexamined Patent Application Publication No. 2005-240178 and Japanese Unexamined Patent Application Publication No. 2004-332099.

Japanese Unexamined Patent Application Publication No. 2005-240178 discloses a low-yield-ratio, high-strength cold-rolled steel sheet having excellent elongation and stretch flangeability and achieving a strength TS as high as 980 MPa or higher. That steel sheet has a steel microstructure satisfying the following in terms of area ratio:retained austenite:at least 5%, bainitic ferrite:at least 60%, polygonal ferrite:20% or less (including 0%). Japanese Unexamined Patent Application Publication No. 2004-332099 discloses a high-strength steel sheet having excellent hole expandability and ductility. That steel sheet has a microstructure composed of a total of 34% to 97% of one or both of bainite and bainitic ferrite as a main phase in terms of area ratio, 3% to 30% of austenite as a second phase in terms of area ratio (Vγ), and the balance being ferrite and/or martensite.

In general, DP steel has a low yield ratio since mobile dislocations are introduced into ferrite during martensite transformation, and thus has a low impact energy absorbing property. With regard to the technology described in Japanese Unexamined Patent Application Publication No. 2011-052295, although the stretch flangeability of the steel sheet is enhanced by performing tempering at high temperature for a short time, the elongation is insufficient with respect to the strength of the steel sheet. The technology described in Japanese Unexamined Patent Application Publication No.

2010-018862 also offers insufficient elongation with respect to the strength, and sufficient formability is not obtained. The steel sheet that utilizes retained austenite according to Japanese Unexamined Patent Application Publication No. 2005-240178 has a low impact energy absorbing property due to a low YR of the obtained steel sheet, and thus elongation and stretch flangeability are not enhanced in the high-strength region of 1180 MPa or higher. According to Japanese Unexamined Patent Application Publication No. 2004-332099, elongation is insufficient with respect to the strength of the steel sheet obtained, and sufficient formability is not obtained.

As described above, it is difficult for high-strength steel sheets having a strength of 1180 MPa or higher to achieve an excellent impact energy absorbing property, excellent press formability, elongation, and hole expandability, and excellent delayed fracture resistance. Currently, there is no steel sheet of any type that achieves these properties (yield ratio, strength, elongation, hole expandability, and delayed fracture resistance).

It could therefore be helpful to provide a high-strength cold-rolled steel sheet having excellent elongation, hole expandability, and delayed fracture resistance as well as a high yield ratio, and a method of producing such a high-strength cold-rolled steel sheet.

SUMMARY

We thus provide:

[1] A high-yield-ratio, high-strength cold-rolled steel sheet having a composition and a microstructure, the steel sheet comprising, in terms of % by mass, C: 0.13% to 0.25%, Si: 1.2% to 2.2%, Mn: 2.0% to 3.2%, P: 0.08% or less, S: 0.005% or less, Al: 0.01% to 0.08%, N: 0.008% or less, Ti: 0.055% to 0.130%, and the balance being Fe and unavoidable impurities, the microstructure comprising 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite, and the bainite and the tempered martensite having an average crystal grain diameter of 5 μm or less.

[2] The high-yield-ratio, high-strength cold-rolled steel sheet described in [1] above, in which the composition further includes, in terms of % by mass, B: 0.0003% to 0.0050%.

[3] The high-yield-ratio, high-strength cold-rolled steel sheet described in [1] or [2] above, in which the composition further includes, in terms of % by mass, at least one selected from V: 0.05% or less and Nb: 0.05% or less.

[4] The high-yield-ratio, high-strength cold-rolled steel sheet described in any one of [1] to [3] above, in which the composition further includes, in terms of % by mass, at least one selected from Cr: 0.50% or less, Mo: 0.50% or less, Cu: 0.50% or less, and Ni: 0.50% or less.

[5] The high-yield-ratio, high-strength cold-rolled steel sheet described in any one of [1] to [4] above, in which the composition further includes, in terms of % by mass, Ca and/or REM in a total of 0.0050% or less.

[6] A method of producing a high-yield-ratio, high-strength cold-rolled steel sheet, including:

heating a steel slab having the composition described in any one of [1] to [5] above to a temperature of 1150° C. to 1300° C., hot rolling the heated slab at a finishing delivery temperature of 850° C. to 950° C., starting cooling of the hot-rolled steel sheet within 1 second after completion of hot rolling, cooling the hot-rolled steel sheet to 650° C. or lower at a first average cooling rate of 80° C./s or more to conduct first cooling, cooling the resulting steel sheet to a temperature of 550° C. or lower at a second average cooling rate of 5° C./s or more to conduct second cooling, coiling the resulting steel sheet to obtain a hot-rolled steel sheet, pickling the hot-rolled steel sheet, cold rolling the pickled steel sheet, and performing continuous annealing that involves heating the resulting cold-rolled steel sheet to a temperature zone of 820° C. or higher at an average heating rate of 3 to 30° C./s, holding the heated steel sheet at a first soaking temperature of 820° C. or higher for 30 seconds or longer, cooling the resulting soaked steel sheet from the first soaking temperature to a cooling stop temperature zone of 100° C. to 250° C. at an average cooling rate of 3° C./s or more, heating the resulting steel sheet to 350° C. to 500° C., holding the heated steel sheet at a second soaking temperature in a temperature zone of 350° C. to 500° C. for 30 seconds or longer, and cooling the resulting soaked steel sheet to room temperature.

A significantly high tensile strength is achieved as well as excellent workability such as high elongation and hole expandability. After the steel sheet is formed into parts, delayed fracture caused by hydrogen from the ambient environment does not easily occur and the parts exhibit excellent delayed fracture resistance. For example, we provide a high-yield-ratio, high-strength cold-rolled steel sheet having excellent elongation, hole expandability, and delayed fracture resistance, in which the tensile strength is as high as 1180 MPa or more, the yield ratio is as high as 75% or more, the elongation is 17.0% or more, the hole expansion ratio is 40% or more, and fracture does not occur for 100 hours when the steel sheet is immersed in hydrochloric acid at 25° C. with pH of 2.

DETAILED DESCRIPTION

We found that when the volume fractions of the ferrite, retained austenite, martensite, bainite, and tempered martensite in the microstructure of the steel sheet are controlled to specific fractions and when their average crystal grain diameters are decreased and fine carbides are allowed to occur in the steel sheet microstructure, high ductility, high hole expandability, and excellent delayed fracture resistance can be obtained while ensuring a high yield ratio.

First, we studied the relationship between the microstructure of the steel sheet and various properties described above such as tensile strength, yield ratio, elongation, hole expandability, and delayed fracture resistance, and found the following:

When hard martensite or retained austenite is present in the steel sheet microstructure, voids occur at the interface, in particular, the interface between soft ferrite and the martensite or retained austenite, during blanking performed in a hole expanding test, and the voids connect to one another and grow in the subsequent hole expanding process, thereby generating cracks. Meanwhile, the presence of soft ferrite and retained austenite in the steel sheet microstructure improves elongation. When prior-γ grain boundaries are present in the steel sheet microstructure, hydrogen entering the steel sheet becomes trapped by the prior-γ grain boundaries and this notably decreases the grain boundary strength. As a result, the crack growth rate after occurrence of crack is increased, and the delayed fracture resistance is degraded. The yield ratio increases when bainite having a high dislocation density or tempered martensite is present in the steel sheet microstructure. However, the effect on elongation is small.

We further found that when a steel sheet microstructure is formed by adjusting the volume fractions of the soft phases and the hard phases, which are the source of voids, and allowing tempered martensite and bainite, which are medium-hard phases, to occur, and making the crystal grains finer, strength and hole expandability can be obtained while allowing some soft ferrite to exist. We also found that fine carbides contained in the steel sheet microstructure form hydrogen trapping sites and help obtain delayed fracture resistance and strength. Thus, excellent elongation, delayed fracture resistance, and hole expandability and high yield ratio are obtained.

Regarding delayed fracture resistance, since presence of prior-γ grain boundaries increases the crack growth rate, annealing is preferably conducted at a dual-phase annealing temperature that enables incorporation of ferrite. We also found that occurrence of fine carbides generates hydrogen trapping sites and decreases hydrogen involved in embrittlement, and thus the delayed fracture resistance is improved. The presence of ferrite in the steel sheet microstructure may decrease strength and hole expandability. We further found that when fine carbides are precipitated, recrystallization temperature and rate during heating in the annealing process is controlled, and the steel sheet microstructure is made finer, it is possible to suppress voids from becoming connected to one another, i.e., the phenomenon that will adversely affect hole expandability.

When an appropriate amount of Ti, which is an element that causes precipitation of fine carbides, is added, and carbides are finely dispersed and dissolved in the microstructure of a hot-rolled steel sheet, the steel sheet microstructure (crystal grains) can be prevented from coarsening during the subsequent continuous annealing process and can be made finer during annealing. Since addition of an appropriate amount of Ti increases the single-phase annealing temperature (Ac3 point), dual phase annealing can be stably conducted. We found that the steel sheet microstructure forms as the steel sheet goes through bainite transformation in the subsequent cooling process and retained austenite, bainite, and tempered martensite are formed in the process of tempering martensite generated during cooling.

We still further found that when 0.055% to 0.130% by mass of Ti is added and the steel sheet is heat-treated under appropriate hot rolling and annealing conditions, the crystal grain diameters of ferrite, retained austenite, martensite, bainite, and tempered martensite can be decreased and the volume fraction of retained austenite can be adjusted to a level sufficient to reliably obtain elongation, and also that when the volume fractions of ferrite and martensite are controlled within the range in which strength and ductility are not adversely affected, elongation, hole expandability, and delayed fracture resistance can be improved while achieving high yield ratio.

Reasons for limiting the composition of the high-strength cold-rolled steel sheet are described. In the description below, "%" indicating the content means % by mass.

C: 0.13% to 0.25%

Carbon (C) is an element effective to increase the strength of a steel sheet, contributes to formation of second phases such as bainite, tempered martensite, retained austenite, and martensite, and increases the hardness of martensite and tempered martensite. At a C content less than 0.13%, it becomes difficult to reliably achieve the needed bainite, tempered martensite, retained austenite, and martensite volume fractions. Thus, the C content is 0.13% or more, preferably 0.15% or more, and more preferably 0.17% or more. At a C content exceeding 0.25%, the difference in hardness among ferrite, tempered martensite, and martensite is increased, and thus hole expandability is degraded. Thus, the C content is 0.25% or less and preferably 0.23% or less.

Si: 1.2% to 2.2%

Silicon (Si) effects solid solution-strengthening ferrite, decreasing the difference in hardness with respect to hard phases, and improving hole expandability. The Si content must be 1.2% or more and is preferably 1.3% or more to obtain these effects. Since addition of excessive Si decreases chemical treatmentability, the Si content is 2.2% or less and preferably 2.0% or less.

Mn: 2.0% to 3.2%

Manganese (Mn) is an element that contributes to increasing strength by solid solution strengthening and generating second phases. Manganese is also an element that stabilizes austenite and is needed to control the second phase fractions. The Mn content needs to be 2.0% or more and is preferably 2.3% or more to obtain these effects. When excessive Mn is contained, the martensite volume fraction increases excessively, and the hardness of martensite and tempered martensite increases, thereby degrading hole expandability. Moreover, when hydrogen enters the steel sheet, restrains on grain boundary slip increase, and growth of cracks at the crystal grain boundaries is promoted, resulting in degradation of delayed fracture resistance. Thus, the Mn content is 3.2% or less and preferably 2.9% or less.

P: 0.08% or Less

Phosphorus (P) contributes to increasing strength by solid-solution strengthening, but extensively segregates in grain boundaries and causes grain boundary embrittlement when added excessively. Moreover, weldability is degraded. Thus, the P content is 0.08% or less, and preferably 0.05% or less.

S: 0.005% or Less

At a high S content, sulfides such as MnS occur in large quantities, and local elongation such as hole expandability is degraded. Thus, the S content is 0.005% or less and preferably 0.0045% or less. The lower limit is not particularly set. However, since excessively decreasing S content increases the steel making cost, the S content is preferably 0.0005% or more.

Al: 0.01% to 0.08%

Aluminum (Al) is a deoxidizing element. The Al content needs to be 0.01% or more to obtain this effect. Since the effect is saturated beyond the Al content of 0.08%, the Al content is 0.08% or less. Preferably, the Al content is 0.05% or less.

N: 0.008% or Less

Nitrogen (N) forms coarse nitrides and deteriorates bendability and stretch flangeability. Thus, the N content needs to be low. At an N content exceeding 0.008%, this tendency becomes notable. Thus, the N content is 0.008% or less and preferably 0.005% or less.

Ti: 0.055% to 0.130%

Titanium (Ti) generates fine carbides and is an important element that contributes to making finer crystal grains and generating hydrogen trapping sites. The Ti content needs to be 0.055% or more to obtain these effects. The Ti content is preferably 0.065% or more and is more preferably 0.080% or more. When Ti is added in an amount exceeding 0.130%, elongation is notably decreased. Thus, the Ti content is 0.130% or less and preferably 0.110% or less.

B: 0.0003% to 0.0050%, at least one selected from V: 0.05% or less and Nb: 0.05% or less, at least one selected from Cr: 0.50% or less, Mo: 0.50% or less, Cu: 0.50% or less, and Ni: 0.50% or less, and a total of 0.0050% or less of Ca and/or REM may be separately or simultaneously added to the components described above.

B: 0.0003% to 0.0050%

Boron (B) is an element that improves hardenability, contributes to increasing the strength by generating a second phase, and prevents the martensite transformation start temperature from decreasing while maintaining hardenability. Boron contributes to improving hole expandability. Thus, B can be added as needed. The B content is 0.0003% or more to obtain these effects. At a B content exceeding 0.0050%, the effects are saturated. Thus, the B content is 0.0050% or less and preferably 0.0040% or less.

V: 0.05% or Less

Vanadium (V) contributes to increasing strength by forming fine carbonitrides. The V content is preferably 0.01% or more to obtain this effect. Since incorporation of a large quantity of V exceeding 0.05% does not have a significant strength-increasing effect and increases the alloying cost, the V content is 0.05% or less.

Nb: 0.05% or Less

Niobium (Nb), as with V, forms fine carbonitrides and can contribute to increasing strength. Thus, Nb may be added as needed. The Nb content is preferably 0.005% or more to obtain this effect. Since incorporation of a large quantity of Nb exceeding 0.05% notably decreases elongation, the Nb content is 0.05% or less.

Cr: 0.50% or Less

Chromium (Cr) is an element that contributes to increasing strength by forming a second phase and can be added as needed. The Cr content is preferably 0.10% or more to obtain this effect. At a Cr content exceeding 0.50%, excessive martensite is generated. Thus, the Cr content is 0.50% or less.

Mo: 0.50% or Less

Molybdenum (Mo), as with Cr, is an element that contributes to increasing strength by forming a second phase. Molybdenum is also an element that contributes to increasing strength by partly forming carbides, and may be added as needed. The Mo content is preferably 0.05% or more to obtain these effects. The effects are saturated when the Mo content exceeds 0.50%. Thus, the Mo content is 0.50% or less.

Cu: 0.50% or Less

Copper (Cu), as with Cr, is an element that contributes to increasing strength by forming a second phase. Copper is also an element that contributes to increasing strength by solid solution strengthening and can be added as needed. The Cu content is preferably 0.05% or more to obtain these effects. The effects are saturated when the Cu content exceeds 0.50%, and surface defects attributable to Cu readily occur. Thus, the Cu content is 0.50% or less.

Ni: 0.50% or Less

Nickel (Ni), as with Cr, is also an element that contributes to increasing strength by forming a second phase. As with Cu, Ni is an element that contributes to increasing strength by solid solution strengthening, and can be added as needed. The Ni content is preferably 0.05% or more to obtain these effects. When Ni and Cu are added simultaneously, surface defects caused by Cu are reduced. Thus, Ni is effective when Cu is added. Since the effects are saturated at a Ni content exceeding 0.50%, the Ni content is 0.50% or less.

Total of 0.0050% or Less of Ca and/or REM

Calcium and REM are elements that make sulfides spherical and contribute to diminishing adverse effects of sulfides on hole expandability, and can be added as needed. The Ca and/or REM is preferably added in a total amount of 0.0005% or more to obtain these effects. The effects are saturated when Ca and/or REM is added in a total amount exceeding 0.0050%. Thus, the total amount of Ca and REM is 0.0050% or less regardless of whether one or both of Ca and REM are added.

The balance is Fe and unavoidable impurities. Examples of the unavoidable impurities include Sb, Sn, Zn, and Co, and the allowable content ranges for these elements are Sb: 0.01% or less, Sn: 0.1% or less, Zn: 0.01% or less, and Co: 0.1% or less. The effects can be still achieved when Ta, Mg, and Zr are contained within typical steel composition ranges.

Next, the microstructure of a high-yield-ratio, high-strength cold-rolled steel sheet is described in detail.

A high-yield-ratio, high-strength cold-rolled steel sheet has a microstructure that contains 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite, and wherein an average crystal grain diameter of the bainite and the tempered martensite is 5 μm or less. In the description below, a volume fraction refers to a volume fraction with respect to the entire steel sheet.

Volume Fraction of Ferrite Having an Average Crystal Grain Diameter of 2 μm or Less: 2% to 15%

Elongation is difficult to obtain when the ferrite volume fraction is less than 2%. Thus, the ferrite volume fraction is 2% or more, and preferably more than 5%. When the ferrite volume fraction exceeds 15%, the amount of voids generated during blanking increases, and the hardness of martensite and tempered martensite needs to be increased to obtain strength. Thus it is difficult to achieve both strength and hole expandability. Thus, the ferrite volume fraction is 15% or less, and preferably 12% or less and more preferably less than 10%. When the average crystal grain diameter of ferrite exceeds 2 pin, voids generated at blanked edges during hole expansion tend to connect to each other during the hole expanding process, and thus good hole expandability is no longer obtained. Thus, the average crystal grain diameter of ferrite is 2 μm or less.

Volume Fraction of Retained Austenite Having Average Crystal Grain Diameter of 0.3 to 2.0 μm: 5% to 20%

Retained austenite has an effect of improving ductility. A sufficient elongation cannot be obtained when the retained austenite volume fraction is less than 5%. Thus, the retained austenite volume fraction is 5% or more, and preferably 8% or more. When the retained austenite volume fraction exceeds 20%, hole expandability is degraded. Thus, the retained austenite volume fraction is 20% or less, and preferably 18% or less. When retained austenite has an average crystal grain diameter less than 0.3 its contribution to elongation is small and a sufficient elongation is difficult to obtain. Thus, the average crystal grain diameter of retained austenite is 0.3 μm or more. When the average crystal grain diameter of retained austenite exceeds 2.0 voids generated in the hole expanding test tend to become connected to one another. Thus, the average crystal grain diameter of retained austenite is 2.0 μm or less.

Volume Fraction of Martensite Having Average Crystal Grain Diameter of 2 μm or Less: 10% or Less (Including 0%)

The martensite volume fraction is 10% or less to obtain the desired strength and hole expandability at the same time. The martensite volume fraction is preferably 8% or less and may be 0%. When the average grain diameter of martensite exceeds 2 voids that occur at the interface with ferrite easily become connected to one another and hole expandability is degraded. Thus, the average grain diameter of martensite is 2 μm or less. Martensite refers to martensite that occurs when austenite, which has remained untransformed after being held in a second soaking temperature zone of 350° C. to 500° C. during continuous annealing, is cooled to room temperature.

Balance being Bainite and Tempered Martensite Having Average Crystal Grain Diameter of 5 μm or Less The balance other than ferrite, retained austenite, and martensite described above must contain bainite and tempered martensite to obtain good hole expandability and high yield ratio. The average crystal grain diameter of bainite and tempered martensite is 5 μm or less. When the average crystal grain diameter exceeds 5 μm, voids occurring at the interface with ferrite become easily connected to one another and hole expandability is degraded. The average crystal grain diameter of the microstructure is determined by using a steel sheet microstructure image obtained by structural observation with a scanning electron microscope (SEM), as described below. According to this method, bainite and tempered martensite are difficult to distinguish from each other. Thus, diameters of crystal grains of bainite and tempered martensite are measured and the results are averaged to determine the average crystal grain diameter of the microstructure formed of bainite and tempered martensite. This average is assumed to be the average crystal grain diameter of bainite and tempered martensite. When the average crystal grain diameter of bainite and tempered martensite determined as such is 5 μm or less, good hole expandability and high yield ratio can be obtained as described above.

Bainite and tempered martensite can be distinguished from each other through a more detailed structural observation using a field emission-scanning electron microscope (FE-SEM), an electron back scatter diffraction (EBSD) system, or a transmission electron microscope (TEM). When bainite and tempered martensite are distinguished from each other by such a structural observation, the bainite volume fraction is preferably 15% or more and 50% or less and the tempered martensite volume fraction is preferably 30% or more 70% or less. The bainite volume fraction referred to is a volume fraction of bainitic ferrite (ferrite with high dislocation density) occupying the observation area. Tempered martensite refers to martensite generated as follows: untransformed austenite partly transforms into martensite during cooling to 100° C. to 250° C. in the annealing process and this martensite becomes tempered by being heated to a temperature zone of 350° C. to 500° C. and held thereat to form the tempered martensite.

Pearlite and other phases may occur in addition to ferrite, retained austenite, martensite, bainite, and tempered martensite. As long as the above-described volume fractions and average crystal grain diameters of ferrite, retained austenite, and martensite are satisfied and the balance contains bainite and tempered martensite having a specified average crystal grain diameter, the desired effects can be achieved. The total volume fraction of the structures such as pearlite, other than ferrite, retained austenite, martensite, bainite, and tempered martensite is preferably 3% or less.

The steel sheet microstructure preferably contains Ti-based precipitates having an average grain diameter of 0.10 μm or less. When the average grain diameter of the Ti-based precipitates is 0.10 μm or less, the strain around the Ti-based precipitates can effectively act as resistance against movement of dislocations, and contributes to increasing strength of steel and to increasing the yield ratio after annealing.

Next, a method of producing a high-yield-ratio, high-strength cold-rolled steel sheet is described.

The high-yield-ratio, high-strength cold-rolled steel sheet can be produced by the following process. A steel slab having the above-described composition is heated to a heating temperature of 1150° C. to 1300° C. and hot-rolled at a finishing delivery temperature of 850° C. to 950° C. Within 1 second after hot rolling is completed, cooling is started. The resulting product is cooled to a temperature of 650° C. or lower at a first average cooling rate of 80° C./s or more to conduct first cooling, then cooled to a temperature of 550° C. or lower at a second average cooling rate of 5° C./s to conduct second cooling, and then coiled to form a hot-rolled steel sheet. The hot-rolled steel sheet is pickled and cold-rolled. The resulting cold-rolled sheet then subjected to continuous annealing, in which the cold-rolled sheet is heated to a temperature zone of 820° C. or higher at an average heating rate of 3 to 30° C./s, held at a first soaking temperature of 820° C. or higher for 30 seconds or longer, and cooled from the first soaking temperature to a cooling stop temperature zone of 100° C. to 250° C. at an average cooling rate of 3° C./s or more. Then the resulting sheet is heated to 350° C. to 500° C. and retained at a second soaking temperature in the temperature zone of 350° C. to 500° C. for 30 seconds or longer, and cooled to room temperature.

As described above, the high-yield-ratio, high-strength cold-rolled steel sheet can be produced by sequentially performing a hot rolling step of hot-rolling a steel slab, and cooling and coiling the resulting product, a pickling step of pickling the hot-rolled steel sheet, a cold rolling step of cold-rolling the pickled steel sheet, and an annealing step of continuously annealing the pickled and cold-rolled steel sheet. The production conditions are described in detail below.

The steel slab is preferably produced by a continuous casting method to prevent macrosegregation of components. Alternatively, the steel slab can be produced by an ingoting method or a thin slab casting method. A conventional method that involves cooling the obtained steel slab to a room temperature and then re-heating the cooled slab can be employed. Alternatively, an energy-saving process such as a direct rolling process, that involves charging a hot slab as is into a heating furnace without cooling, immediately rolling the hot slab after recuperating, or directly rolling the as-casted slab can be employed without any problem.

Hot Rolling Step

Heating Temperature (Preferable Condition): 1150° C. to 1300° C.

A steel slab having the above-described composition and having a temperature of 1150° C. to 1300° C. is preferably hot-rolled after casting without reheating. Alternatively, a steel slab is preferably re-heated to a temperature of 1150° C. to 1300° C. and then hot-rolled. The rolling load increases and productivity may be degraded when the heating temperature is lower than 1150° C. Thus, the heating temperature is preferably 1150° C. or higher. The heating cost rises without any beneficial effects when the heating temperature is higher than 1300° C. Thus, the heating temperature is preferably 1300° C. or lower.

Finishing Delivery Temperature: 850° C. to 950° C.

Hot rolling needs to end in the austenite single phase zone to make the microstructure in the steel sheet homogeneous, decrease anisotropy of the material, and improve elongation and hole expandability after annealing. Thus, the finishing delivery temperature of the hot rolling is 850° C. or higher. At a finishing delivery temperature exceeding 950° C., the microstructure of the hot-rolled steel sheet becomes coarse and properties after annealing are degraded. Thus, the finishing delivery temperature is 950° C. or lower.

Cooling Conditions after Hot Rolling: Cooling is Started within 1 Second after Hot Rolling is Completed, First Cooling is Conducted at a First Average Cooling Rate of 80° C./s or More to a Temperature of 650° C. or Lower, and Second Cooling is Conducted at a Second Average Cooling Rate of 5° C./s or More to a Temperature of 550° C. or Lower Cooling is started within 1 second after hot rolling is completed. In this manner, the hot-rolled steel sheet is quenched to a bainite transformation temperature zone without causing ferrite transformation, and the microstructure of the hot-rolled steel sheet becomes a homogenous bainite structure. Such control of the microstructure of the hot-rolled steel sheet has an effect of making mainly ferrite and martensite finer in the final product steel sheet microstructure. If a time longer than 1 second elapses after completion of hot rolling and before start of cooling, ferrite transformation starts and thus homogeneous bainite transformation becomes difficult. Thus, after completion of hot rolling, in other words, after finish rolling in the hot rolling process is completed, cooling (first cooling) is started within 1 second and the hot-rolled steel sheet is cooled to a temperature of 650° C. or lower at an average cooling rate (first average cooling rate) of 80° C./s or more. If the first average cooling rate, which is the average cooling rate of the first cooling, is less than 80° C./s, ferrite transformation starts during cooling. Thus, the steel sheet microstructure of the hot-rolled steel sheet becomes inhomogeneous and hole expandability of the steel sheet after annealing is degraded. If the temperature at the end of cooling in the first cooling (cooling stop temperature of first cooling) process is higher than 650° C., pearlite occurs excessively, the microstructure of the hot-rolled steel sheet becomes inhomogeneous, and hole expandability of the steel sheet after annealing is degraded. Thus, cooling is started within 1 second after completion of hot rolling, and first cooling is performed to a temperature of 650° C. or lower at a first average cooling rate of 80° C./s or more. The cooling stop temperature of the first cooling is preferably 600° C. or higher. The first average cooling rate is the average cooling rate from the temperature at the end of the hot rolling to the cooling stop temperature of the first cooling. After the first cooling, a second cooling process of cooling the sheet to a temperature of 550° C. or lower is performed at an average cooling rate of 5° C./s or more. If the second average cooling rate, which is the average cooling rate of the second cooling, is less than 5° C./s or the second cooling is performed to a temperature higher than 550° C., excessive ferrite and pearlite occur in the microstructure of the hot-rolled steel sheet, and hole expandability of the steel sheet after annealing is degraded. Thus, the second cooling is conducted to a temperature of 550° C. or lower at a second average cooling rate of 5° C./s or more. The average cooling rate of the second cooling is preferably 45° C./s or less. The second average cooling rate is the average cooling rate from the cooling stop temperature of the first cooling to the coiling temperature.

Coiling Temperature: 550° C. or Lower

As described above, after hot rolling, first cooling is performed and then second cooling is performed to cool the steel sheet to a temperature equal to or lower than 550° C., and then the steel sheet is coiled at a coiling temperature of 550° C. or lower to obtain a hot-rolled steel sheet. At a coiling temperature exceeding 550° C., excessive ferrite and pearlite occur. Thus, the coiling temperature is 550° C. or lower. Preferably, the coiling temperature is 500° C. or lower. Although the lower limit of the coiling temperature is not particularly specified, hard martensite occurs excessively and the cold rolling load is increased if the coiling temperature is excessively low. Thus, the coiling temperature is preferably 300° C. or higher.

Pickling Step

After the hot rolling step, a pickling step is preferably performed to remove scales on the hot-rolled steel sheet surface layer formed in the hot rolling step. The pickling step is not particularly limited and may be conducted according to a known procedure.

Cold Rolling Step

A cold rolling step of rolling the pickled steel sheet to a particular thickness to obtain a cold rolled sheet is performed. The conditions for the cold rolling step are not particularly limited, and cold rolling may be conducted according to a known procedure.

Annealing Step

In the annealing step, recrystallization is allowed to proceed and bainite, tempered martensite, retained austenite, and martensite are formed in the steel sheet microstructure to increase strength. Thus, in the annealing step, the following continuous annealing is performed: the steel sheet is heated to a temperature zone of 820° C. or higher at an average heating rate of 3 to 30° C./s, held at a first soaking temperature of 820° C. or higher for 30 seconds or longer, cooled from the first soaking temperature to a cooling stop temperature zone of 100° C. to 250° C. at an average cooling rate of 3° C./s or more, heated to 350° C. to 500° C., held at a second soaking temperature in the temperature zone of 350° C. to 500° C. for 30 seconds or longer, and cooled to room temperature.

The reasons for limiting the conditions are described below.

Average Heating Rate: 3 to 30° C./s

When the nucleation rate of ferrite and austenite generated as a result of recrystallization in the temperature elevation process during annealing is higher than the rate at which recrystallized crystal grains grow, recrystallized crystal grains can be made finer. The average heating rate during heating the sheet to a temperature zone of 820° C. or higher is 3° C./s or more to obtain this effect. If the average heating rate is less than 3° C./s, ferrite and martensite grains after annealing become coarse and the desired average grain diameter is not obtained. Preferably, the average heating rate is 5° C./s or more. Recrystallization is obstructed if rapid heating is conducted at an average heating rate exceeding 30° C./s. Thus, the average heating rate is 30° C./s or less.

First Soaking Temperature: 820° C. or Higher

After the steel sheet is heated to a temperature zone of 820° C. or higher at the average heating rate described above, soaking is conducted in a temperature zone that is either a ferrite-austenite dual phase zone or an austenite single-phase zone while maintaining the soaking temperature (first soaking temperature) to a temperature of 820° C. or higher. At a first soaking temperature lower than 820° C., the ferrite fraction increases and thus it becomes difficult to achieve strength and hole expandability at the same time. Thus, the first soaking temperature is 820° C. or higher. The upper limit is not particularly specified. When the soaking temperature is excessively high, annealing is performed in the austenite single phase zone and thus delayed fracture resistance tends to be degraded. Thus, the first soaking temperature is preferably 900° C. or lower and more preferably 880° C. or lower.

First Soaking Temperature Holding Time: 30 Seconds or Longer

The first soaking temperature holding time (hereinafter may be referred to as the first holding time) needs to be 30 seconds or longer to allow recrystallization to proceed and carry out partial or complete austenite transformation at the first soaking temperature described above. Preferably, the first holding time is 100 seconds or longer. The upper limit of the first holding time is not particularly limited but is preferably 600 seconds or shorter.

Cooling from First Soaking Temperature to Cooling Stop Temperature Zone of 100° C. to 250° C. at Average Cooling Rate of 3° C./s or More To generate tempered martensite from the viewpoint of achieving high yield ratio and hole expandability, cooling is performed from the soaking temperature to a temperature equal to or lower than the martensite transformation start temperature so that austenite generated during holding the steel sheet at the first soaking temperature is partly transformed into martensite. Thus, the average cooling rate is 3° C./s or more and cooling performed to a cooling stop temperature zone of 100° C. to 250° C. When the average cooling rate is less than 3° C./s, excessive pearlite and spherical cementite occur in the steel sheet microstructure. Thus, the average cooling rate is 3° C./s or more. If the cooling stop temperature is lower than 100° C., excessive martensite occurs during cooling, the amount of untransformed austenite decreases, the amounts of bainite and retained austenite decrease, and elongation decreases. Thus, the cooling stop temperature is 100° C. or higher. Preferably, the cooling stop temperature is 150° C. or higher. At a cooling stop temperature higher than 250° C., the amount of tempered martensite decreases and hole expandability is degraded. Thus, the cooling stop temperature is 250° C. or lower, and preferably 220° C.

Heating the Steel Sheet to 350° C. to 500° C., Holding the Heated Steel Sheet at a Second Soaking Temperature in the Temperature Zone of 350° C. to 500° C. for 30 Seconds or Longer, and Cooling the Soaked Steel Sheet to Room Temperature The steel sheet is held at a second soaking temperature to temper martensite generated during cooling to form tempered martensite and transform untransformed austenite into bainite to form bainite and retained austenite in the steel sheet microstructure. At a second soaking temperature lower than 350° C., martensite is insufficiently tempered, and the difference in hardness between ferrite and martensite increases, thereby degrading hole expandability. Thus, the second soaking temperature is 350° C. or higher. At a second soaking temperature higher than 500° C., excessive pearlite occurs and elongation is decreased. Thus, the second soaking temperature is 500° C. or lower. Bainite transformation does not proceed sufficiently if the time the second soaking temperature is held (hereinafter also referred to as a second holding time) is shorter than 30 seconds. As a result, a large quantity of untransformed austenite remains, excessive martensite eventually occurs, and hole expandability is degraded. Thus, the second holding time is 30 seconds or longer and preferably 60 seconds or longer. The upper limit of the second holding time is not particularly limited but is preferably 2000 seconds or shorter.

Skin pass rolling may be conducted after the continuous annealing described above. The preferable range of elongation for temper rolling is 0.1% to 2.0%.

In the annealing step described above, hot-dip galvanization may be conducted to form a hot-dip galvanized steel sheet. After hot-dip galvanizing, galvannealing may be conducted to form a hot-dip galvannealed steel sheet. The obtained cold-rolled steel sheet may be electroplated to form an electroplated steel sheet.

Example 1

Examples will now be described. It should be noted that this disclosure is not limited by the examples described below and is subject to modifications and alterations without departing from the scope of the appended claims. Such modifications and alterations are all included in the technical scope of this disclosure.

A steel having a composition shown in Table 1 (balance components: Fe and unavoidable impurities) was melted and cast into a slab. The slab was hot-rolled at a hot rolling heating temperature of 1250° C. and a finishing delivery temperature (FDT) shown in Table 2 into a steel sheet having a thickness of 3.2 mm. This steel sheet was cooled to a first cooling temperature at a first average cooling rate (cooling rate 1) shown in Table 2, then cooled at a second average cooling rate (cooling rate 2), and coiled at a coiling temperature (CT) to obtain a hot-rolled steel sheet. Table 2 also shows the time elapsed until cooling starts after completion of hot rolling. The resulting hot-rolled steel sheet was pickled and cold rolled into a cold rolled sheet (sheet thickness: 1.4 mm). Then continuous annealing was performed in which the cold rolled sheet was heated at an average heating rate shown in Table 2, annealed at a soaking temperature (first soaking temperature) for a soaking time (first holding time) shown in Table 2, then cooled to a cooling stop temperature at an average cooling rate (cooling rate 3) shown in Table 2, heated, and held at a second soaking temperature (for a second holding time) shown in Table 2, and cooled to room temperature. As a result, a cold-rolled steel sheet was obtained.

The cold-rolled steel sheets produced as such were evaluated in terms of the following properties and microstructures thereof were studied. The results are shown in Table 3.

Tensile Properties

A JIS No. 5 tensile test specimen was taken from the obtained cold-rolled steel sheet so that the longitudinal direction (tensile direction) was coincident with the direction at a right angle to the rolling direction. The specimen was subjected to a tensile test (JIS Z2241 (1998)) to determine yield stress (YS), tensile strength (TS), total elongation (EL), and yield ratio (YR).

Stretch flangeability

A specimen taken from the obtained cold-rolled steel sheet was blanked to form a 10 mm $\phi$ hole in accordance with the Japan Iron and Steel Federation Standard (JFS T1001 (1996)) at a clearance of 12.5% of the sheet thickness, and loaded onto a tester so that the burr faces the die. Then the specimen was worked by using a 60° conical die, and hole expansion ratio ($\lambda$) was measured. Steel sheets that exhibited $\lambda$ (%) of 40% or more were assumed to have excellent stretch flangeability.

Delayed Fracture Resistance

A 30 mm×100 mm piece was taken from the obtained cold-rolled steel sheet so that the longitudinal direction was coincident with the rolling direction of the cold-rolled steel sheet, and edges were polished to prepare a test piece. The test piece was subjected to 180° bending work by using a punch having a tip having a curvature radius of 10 mm. The spring back that occurred in the bended test piece was clamped with bolts so that the inner spacing was 20 mm to apply stress to the test piece. Then the test piece was immersed in hydrochloric acid having a temperature of 25° C. and pH of 2. The time-to-fracture was determined with 100 hours set as at maximum. Test pieces that did not crack within 100 hours were assumed to have excellent delayed fracture resistance (indicated by circle marks), and test pieces that cracked were assumed to have poor delayed fracture resistance (indicated by X marks).

Microstructure of Steel Sheet

The volume fractions of ferrite and martensite in the cold-rolled steel sheet were determined as follows. A sheet-thickness section taken in a direction parallel to the rolling direction of the steel sheet was polished, corroded with 3% nital, and observed with a scanning electron microscope (SEM) at a magnification of 2000 and 5000. The area ratios were measured by a point count procedure (in accordance with ASTM E562-83 (1988)), and were assumed to be the volume fractions. The average crystal grain diameter of ferrite and martensite was determined by using Image-Pro produced by Media Cybernetics Inc., as follows: ferrite and martensite crystal grains were identified from a steel sheet microstructure photograph obtained by SEM structural observation conducted as described above, this photograph was processed to calculate the areas of the ferrite and martensite crystal grains, and the equivalent circle diameters of the grains were calculated and averaged for each phase to obtain average crystal grain diameters of the ferrite and martensite crystal grains.

The volume fraction of retained austenite was determined by polishing the cold-rolled steel sheet to expose a surface at a depth of ¼ of the sheet thickness, and determining the X-ray diffraction intensity at this surface at a depth of ¼ of the sheet thickness. By using the Mo Kα line as a line source, the integral intensities of the X-ray diffracted lines from the {200} plane, {211} plane, and {220} of ferrous ferrite, and {200} plane, {220} plane, and {311} plane of austenite were measured at an acceleration voltage of 50 keV by an X-ray diffraction method (instrument: RINT 2200 produced by Rigaku Corporation). Based on the observed values, the volume fraction of the retained austenite was calculated from the formula described in lines 62 to 64, p. 26 of "X-ray Diffraction Handbook" (2000), Rigaku Denki Co., Ltd. The average crystal grain diameter of the retained austenite was determined by observing the retained austenite by an electron back scattering diffraction (EBSD) method at a magnification of 5000, calculating the equivalent circle diameters with Image-Pro described above, and averaging the results.

The steel sheet microstructure was observed with a scanning electron microscope (SEM), a transmission electron microscope (TEM), and a field effect-scanning electron microscope (FE-SEM) to identify the types of steel sheet phases other than ferrite, retained austenite, and martensite. The average crystal grain diameter of bainite, tempered martensite, and pearlite was determined from a steel sheet microstructure photograph by using Image-Pro described above by calculating the equivalent circle diameters of bainite and tempered martensite crystal grains without distinguishing bainite from tempered martensite and then averaging the obtained values.

For each of the examples, the average grain diameter of the Ti-based carbides was measured with TEM, and was 0.10 μm or less.

The observed tensile properties, hole expansion ratios, delayed fracture resistance, and steel sheet microstructures are shown in Table 3.

The results in Table 3 show that all of our examples have a multiple phase microstructure that contains 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite having an average grain size of 5 μm or less. As a result, a tensile strength of 1180 MPa or more and a yield ratio of 75% or more are reliably obtained, and excellent workability, namely, 17.0% or more of elongation (total elongation) and 40% or more of hole expansion ratio, is obtained. Moreover, we confirmed through a delayed fracture property evaluation test that 100 hour fracture did not occur and that the delayed fracture resistance was excellent. In contrast, none of comparative examples satisfied all of tensile strength, yield ratio, elongation, hole expansion ratio, and delayed fracture resistance.

TABLE 1

| | Composition (mass %) | | | | | | | | | |
|---|---|---|---|---|---|---|---|---|---|---|
| Steel type | C | Si | Mn | P | S | Al | N | Ti | Other elements | Remark |
| A | 0.20 | 1.53 | 2.75 | 0.01 | 0.002 | 0.03 | 0.002 | 0.098 | — | Steel within scope of Invention |
| B | 0.18 | 1.87 | 2.61 | 0.01 | 0.001 | 0.02 | 0.002 | 0.115 | — | Steel within scope of Invention |
| C | 0.20 | 1.45 | 2.43 | 0.01 | 0.001 | 0.03 | 0.003 | 0.095 | B: 0.0015 | Steel within scope of Invention |
| D | 0.22 | 1.39 | 2.81 | 0.01 | 0.001 | 0.03 | 0.002 | 0.071 | V: 0.02 | Steel within scope of Invention |
| E | 0.18 | 1.84 | 2.59 | 0.01 | 0.002 | 0.02 | 0.002 | 0.081 | Nb: 0.03 | Steel within scope of Invention |
| F | 0.21 | 1.42 | 2.51 | 0.02 | 0.001 | 0.03 | 0.003 | 0.077 | Cr: 0.18 | Steel within scope of Invention |
| G | 0.23 | 1.29 | 2.49 | 0.01 | 0.001 | 0.03 | 0.001 | 0.121 | Mo: 0.15 | Steel within scope of Invention |
| H | 0.16 | 2.11 | 2.45 | 0.02 | 0.003 | 0.04 | 0.003 | 0.106 | Cu: 0.18 | Steel within scope of Invention |
| I | 0.18 | 1.21 | 3.01 | 0.01 | 0.002 | 0.03 | 0.002 | 0.091 | Ni: 0.22 | Steel within scope of Invention |
| J | 0.21 | 1.35 | 2.79 | 0.02 | 0.002 | 0.03 | 0.003 | 0.105 | Ca: 0.0028 | Steel within scope of Invention |
| K | 0.16 | 1.38 | 2.91 | 0.01 | 0.001 | 0.03 | 0.002 | 0.112 | REM: 0.0028 | Steel within scope of Invention |
| L | 0.11 | 1.78 | 2.88 | 0.01 | 0.002 | 0.03 | 0.002 | 0.098 | — | Comparative Example |
| M | 0.22 | 0.56 | 3.01 | 0.01 | 0.002 | 0.03 | 0.003 | 0.091 | — | Comparative Example |

TABLE 1-continued

| Steel type | Composition (mass %) C | Si | Mn | P | S | Al | N | Ti | Other elements | Remark |
|---|---|---|---|---|---|---|---|---|---|---|
| N | 0.19 | 2.12 | 1.83 | 0.01 | 0.002 | 0.03 | 0.003 | 0.092 | — | Comparative Example |
| O | 0.18 | 0.89 | 3.56 | 0.02 | 0.002 | 0.04 | 0.003 | 0.088 | — | Comparative Example |
| P | 0.21 | 1.54 | 3.15 | 0.02 | 0.002 | 0.04 | 0.003 | — | — | Comparative Example |

Underlines indicate items outside the ranges of the invention.

TABLE 2

| Sample No. | Steel type | Hot rolling FDT (° C.) | Time until start of cooling (sec) | Cooling rate 1 (° C./s) | First cooling temperature (° C.) | Cooling rate 2 (° C./s) | CT (° C.) | Continuous annealing Average heating rate (° C./s) | First soaking temperature (° C.) | First holding time (sec) | Cooling rate 3 (° C./s) | Cooling stop temperature (° C.) | Second soaking temperature (° C.) | Second holding time (sec) |
|---|---|---|---|---|---|---|---|---|---|---|---|---|---|---|
| 1 | A | 900 | 0.5 | 110 | 600 | 20 | 470 | 10 | 850 | 300 | 5 | 200 | 400 | 600 |
| 2 | A | 900 | 0.5 | 100 | 570 | 25 | 450 | 11 | 870 | 300 | 5 | 225 | 425 | 500 |
| 3 | A | 900 | 0.5 | 120 | 540 | 25 | 470 | 12 | 850 | 300 | 6 | 150 | 400 | 300 |
| 4 | B | 900 | 0.5 | 100 | 600 | 25 | 470 | 10 | 850 | 250 | 8 | 200 | 425 | 600 |
| 5 | B | 900 | 0.5 | 110 | 600 | 22 | 470 | 5 | 850 | 300 | 5 | 200 | 450 | 600 |
| 6 | C | 900 | 0.5 | 120 | 600 | 22 | 550 | 6 | 850 | 300 | 4 | 225 | 400 | 600 |
| 7 | D | 900 | 0.5 | 120 | 580 | 25 | 500 | 3 | 850 | 300 | 10 | 180 | 380 | 600 |
| 8 | E | 900 | 0.5 | 130 | 620 | 40 | 500 | 15 | 820 | 600 | 8 | 250 | 400 | 600 |
| 9 | F | 900 | 0.5 | 150 | 600 | 25 | 500 | 15 | 850 | 300 | 9 | 200 | 450 | 600 |
| 10 | G | 900 | 0.5 | 100 | 580 | 20 | 540 | 15 | 850 | 300 | 7 | 200 | 450 | 600 |
| 11 | H | 900 | 0.5 | 100 | 580 | 15 | 520 | 3 | 900 | 350 | 11 | 220 | 400 | 300 |
| 12 | I | 900 | 0.5 | 85 | 600 | 15 | 470 | 25 | 850 | 500 | 10 | 200 | 450 | 180 |
| 13 | J | 900 | 0.5 | 120 | 600 | 15 | 470 | 5 | 900 | 300 | 14 | 150 | 400 | 500 |
| 14 | K | 900 | 0.5 | 120 | 580 | 15 | 470 | 10 | 900 | 300 | 11 | 200 | 400 | 500 |
| 15 | A | 900 | 0.5 | 50 | 600 | 20 | 470 | 10 | 830 | 300 | 7 | 250 | 480 | 600 |
| 16 | A | 900 | 0.5 | 90 | 750 | 30 | 470 | 10 | 850 | 300 | 5 | 200 | 450 | 600 |
| 17 | A | 900 | 0.5 | 100 | 600 | 2 | 470 | 10 | 850 | 300 | 8 | 200 | 400 | 600 |
| 18 | A | 900 | 0.5 | 100 | 675 | 25 | 650 | 10 | 850 | 300 | 5 | 200 | 400 | 600 |
| 19 | A | 900 | 0.5 | 100 | 600 | 20 | 470 | 1 | 850 | 300 | 5 | 250 | 400 | 600 |
| 20 | A | 900 | 0.5 | 100 | 580 | 20 | 470 | 10 | 780 | 300 | 10 | 250 | 400 | 600 |
| 21 | A | 900 | 0.5 | 100 | 620 | 25 | 470 | 10 | 850 | 300 | 1 | 200 | 400 | 600 |
| 22 | A | 900 | 0.5 | 100 | 600 | 20 | 470 | 10 | 850 | 250 | 7 | 350 | 475 | 600 |
| 23 | A | 900 | 0.5 | 100 | 550 | 25 | 470 | 10 | 850 | 300 | 10 | 50 | 380 | 600 |
| 24 | A | 900 | 0.5 | 100 | 580 | 20 | 500 | 10 | 850 | 300 | 6 | 200 | 550 | 600 |
| 25 | A | 900 | 0.5 | 120 | 600 | 20 | 450 | 10 | 850 | 300 | 7 | 200 | 300 | 500 |
| 26 | A | 900 | 0.5 | 100 | 580 | 20 | 470 | 5 | 850 | 250 | 8 | 250 | 400 | 10 |
| 27 | L | 900 | 0.5 | 100 | 600 | 20 | 450 | 10 | 875 | 300 | 6 | 200 | 420 | 300 |
| 28 | M | 900 | 0.5 | 100 | 600 | 25 | 500 | 10 | 900 | 300 | 5 | 200 | 420 | 500 |
| 29 | N | 900 | 0.5 | 100 | 600 | 20 | 450 | 10 | 820 | 300 | 5 | 200 | 420 | 500 |
| 30 | O | 900 | 0.5 | 100 | 600 | 25 | 500 | 5 | 850 | 300 | 5 | 200 | 450 | 500 |
| 31 | P | 900 | 0.5 | 100 | 600 | 20 | 470 | 10 | 850 | 250 | 6 | 200 | 420 | 600 |

Underlines indicate items outside the ranges of the invention.

TABLE 3

| Sample No. | Steel sheet microstructure: Ferrite Volume fraction (%) | Ferrite Average grain diameter (μm) | Retained austenite Volume fraction (%) | Retained austenite Average grain diameter (μm) | Martensite Volume fraction (%) | Martensite Average grain diameter (μm) | Balance Type | Balance Average grain diameter (μm) |
|---|---|---|---|---|---|---|---|---|
| 1 | 7 | 2 | 10 | 1.2 | 5 | 1 | B, TM | 3 |
| 2 | 7 | 2 | 9 | 1.4 | 7 | 2 | B, TM | 3 |
| 3 | 8 | 1 | 11 | 1.0 | 4 | 2 | B, TM | 4 |
| 4 | 9 | 1 | 7 | 1.2 | 7 | 2 | B, TM | 2 |
| 5 | 5 | 2 | 8 | 1.0 | 6 | 1 | B, TM | 3 |
| 6 | 7 | 1 | 10 | 1.1 | 5 | 1 | B, TM | 3 |
| 7 | 8 | 1 | 11 | 1.2 | 9 | 2 | B, TM | 2 |
| 8 | 12 | 2 | 7 | 0.8 | 8 | 2 | B, TM | 3 |
| 9 | 7 | 2 | 9 | 1.3 | 6 | 1 | B, TM | 2 |
| 10 | 9 | 2 | 11 | 0.9 | 7 | 2 | B, TM | 4 |
| 11 | 4 | 2 | 12 | 1.1 | 6 | 2 | B, TM | 3 |

TABLE 3-continued

| | | | | | | | | |
|---|---|---|---|---|---|---|---|---|
| 12 | 6 | 2 | 9 | 1.3 | 8 | 2 | B, TM | 3 |
| 13 | 3 | 1 | 8 | 1.2 | 7 | 2 | B, TM | 2 |
| 14 | 4 | 2 | 7 | 1.4 | 6 | 1 | B, TM | 3 |
| 15 | 13 | 2 | 11 | 1.4 | 7 | 4 | B, TM | 4 |
| 16 | 8 | 2 | 9 | 1.1 | 6 | 4 | B, TM | 4 |
| 17 | 5 | 3 | 8 | 1.0 | 10 | 3 | B, TM | 4 |
| 18 | 4 | 3 | 7 | 1.6 | 7 | 6 | B, TM | 4 |
| 19 | 6 | 5 | 8 | 0.8 | 8 | 6 | B, TM | 6 |
| 20 | 17 | 3 | 6 | 1.3 | 5 | 2 | B, TM | 4 |
| 21 | 16 | 4 | 9 | 1.2 | 7 | 2 | B, TM, P | 4 |
| 22 | 7 | 2 | 15 | 2.2 | 18 | 7 | B, TM | 3 |
| 23 | 8 | 2 | 4 | 1.3 | 5 | 3 | B, TM | 4 |
| 24 | 7 | 2 | 4 | 1.2 | 6 | 2 | B, TM, P | 4 |
| 25 | 6 | 1 | 12 | 1.5 | 9 | 5 | B, TM | 3 |
| 26 | 6 | 2 | 10 | 1.3 | 12 | 4 | B, TM | 3 |
| 27 | 16 | 4 | 6 | 1.0 | 9 | 2 | B, TM | 4 |
| 28 | 1 | 1 | 8 | 1.5 | 6 | 2 | B, TM | 3 |
| 29 | 17 | 3 | 6 | 1.5 | 5 | 3 | B, TM | 4 |
| 30 | 3 | 2 | 9 | 1.4 | 13 | 3 | B, TM | 4 |
| 31 | 0 | — | 12 | 1.6 | 8 | 3 | B, TM | 4 |

| | Tensile properties | | | | Hole expansion ratio | Delayed | |
|---|---|---|---|---|---|---|---|
| Sample No. | YS (MPa) | TS (MPa) | EL (%) | YR (%) | λ (%) | fracture resistance | Remark |
| 1 | 1079 | 1247 | 19.0 | 87 | 45 | ○ | Example of Invention |
| 2 | 1088 | 1237 | 17.6 | 88 | 43 | ○ | Example of Invention |
| 3 | 1032 | 1222 | 18.9 | 84 | 49 | ○ | Example of Invention |
| 4 | 1052 | 1230 | 18.6 | 86 | 41 | ○ | Example of Invention |
| 5 | 1011 | 1225 | 17.6 | 83 | 46 | ○ | Example of Invention |
| 6 | 1051 | 1255 | 18.3 | 84 | 42 | ○ | Example of Invention |
| 7 | 959 | 1235 | 17.8 | 78 | 40 | ○ | Example of Invention |
| 8 | 1033 | 1238 | 18.9 | 83 | 40 | ○ | Example of Invention |
| 9 | 999 | 1235 | 17.5 | 81 | 43 | ○ | Example of Invention |
| 10 | 1011 | 1205 | 17.6 | 84 | 42 | ○ | Example of Invention |
| 11 | 977 | 1222 | 17.5 | 80 | 43 | ○ | Example of Invention |
| 12 | 988 | 1215 | 17.6 | 81 | 41 | ○ | Example of Invention |
| 13 | 976 | 1195 | 17.2 | 82 | 53 | ○ | Example of Invention |
| 14 | 988 | 1215 | 17.3 | 81 | 47 | ○ | Example of Invention |
| 15 | 921 | 1220 | 17.3 | 75 | 27 | ○ | Comparative Example |
| 16 | 931 | 1186 | 17.0 | 78 | 21 | ○ | Comparative Example |
| 17 | 964 | 1194 | 17.3 | 81 | 21 | ○ | Comparative Example |
| 18 | 1001 | 1244 | 17.5 | 80 | 17 | ○ | Comparative Example |
| 19 | 888 | 1181 | 17.0 | 75 | 12 | ○ | Comparative Example |
| 20 | 805 | 1165 | 17.5 | 69 | 13 | ○ | Comparative Example |
| 21 | 845 | 1122 | 17.8 | 75 | 16 | ○ | Comparative Example |
| 22 | 868 | 1241 | 17.3 | 70 | 12 | ○ | Comparative Example |
| 23 | 911 | 1201 | 14.1 | 76 | 62 | ○ | Comparative Example |
| 24 | 968 | 1221 | 15.5 | 79 | 32 | ○ | Comparative Example |
| 25 | 968 | 1241 | 17.3 | 78 | 22 | ○ | Comparative Example |
| 26 | 868 | 1244 | 17.1 | 70 | 12 | ○ | Comparative Example |
| 27 | 899 | 1181 | 17.4 | 76 | 25 | ○ | Comparative Example |
| 28 | 1015 | 1211 | 16.5 | 84 | 44 | ○ | Comparative Example |
| 29 | 824 | 1128 | 17.5 | 73 | 22 | ○ | Comparative Example |
| 30 | 977 | 1225 | 17.0 | 80 | 35 | X | Comparative Example |
| 31 | 989 | 1225 | 16.8 | 81 | 38 | X | Comparative Example |

Underlines indicate items outside the ranges of the invention.
Balance: B: bainite, TM: tempered martensite, P: pearlite

The invention claimed is:

1. A high-yield-ratio, high-strength cold-rolled steel sheet having a composition and a microstructure, the steel sheet comprising, in terms of % by mass, C: 0.13% to 0.25%, Si: 1.2% to 2.2%, Mn: 2.0% to 3.2%, P: 0.08% or less, S: 0.005% or less, Al: 0.01% to 0.08%, N: 0.008% or less, Ti: 0.055% to 0.130%, and the balance being Fe and unavoidable impurities, the microstructure comprising 2% to 15% of ferrite having an average crystal grain diameter of 2 μm or less in terms of volume fraction, 5 to 20% of retained austenite having an average crystal grain diameter of 0.3 to 2.0 μm in terms of volume fraction, 10% or less (including 0%) of martensite having an average grain diameter of 2 μm or less in terms of volume fraction, and the balance being bainite and tempered martensite, and the bainite and the tempered martensite having an average crystal grain diameter of 5 μm or less.

2. The cold-rolled steel sheet according to claim 1, wherein the composition further comprises, in terms of % by mass, B: 0.0003% to 0.0050%.

3. The cold-rolled steel sheet according to claim 1, wherein the composition further comprises, in teams of % by mass, at least one selected from V: 0.05% or less and Nb: 0.05% or less.

4. The cold-rolled steel sheet according to claim 1, wherein the composition further comprises, in terms of % by mass, at least one selected from Cr: 0.50% or less, Mo: 0.50% or less, Cu: 0.50% or less, and Ni: 0.50% or less.

5. The cold-rolled steel sheet according to claim 1, wherein the composition further comprises, in terms of % by mass, Ca and/or REM in a total of 0.0050% or less.

6. The cold-rolled steel sheet according to claim 2, wherein the composition further comprises, in terms of % by mass, at least one selected from V: 0.05% or less and Nb: 0.05% or less.

7. The cold-rolled steel sheet according to claim 2, wherein the composition further comprises, in terms of % by mass, at least one selected from Cr: 0.50% or less, Mo: 0.50% or less, Cu: 0.50% or less, and Ni: 0.50% or less.

8. The cold-rolled steel sheet according to claim 3, wherein the composition further comprises, in terms of % by mass, at least one selected from Cr: 0.50% or less, Mo: 0.50% or less, Cu: 0.50% or less, and Ni: 0.50% or less.

9. The cold-rolled steel sheet according to claim 2, wherein the composition further comprises, in terms of % by mass, Ca and/or REM in a total of 0.0050% or less.

10. The cold-rolled steel sheet according to claim 3, wherein the composition further comprises, in terms of % by mass, Ca and/or REM in a total of 0.0050% or less.

11. The cold-rolled steel sheet according to claim 4, wherein the composition further comprises, in terms of % by mass, Ca and/or REM in a total of 0.0050% or less.

12. A method of producing a high-yield-ratio, high-strength cold-rolled steel sheet, comprising:

heating a steel slab having the composition according to claim 1 to a temperature of 1150° C. to 1300° C., hot rolling the heated slab at a finishing delivery temperature of 850° C. to 950° C., starting cooling of the hot-rolled steel sheet within 1 second after completion of hot rolling, cooling the hot-rolled steel sheet to 650° C. or lower at a first average cooling rate of 80° C./s or more to conduct first cooling, cooling the resulting steel sheet to a temperature of 550° C. or lower at a second average cooling rate of 5° C./s or more to conduct second cooling, coiling the resulting steel sheet to obtain a hot-rolled steel sheet, pickling the hot-rolled steel sheet, cold rolling the pickled steel sheet, and performing continuous annealing that involves heating the resulting cold-rolled steel sheet to a temperature zone of 820° C. or higher at an average heating rate of 3 to 30° C./s, holding the heated steel sheet at a first soaking temperature of 820° C. or higher for 30 seconds or longer, cooling the resulting soaked steel sheet from the first soaking temperature to a cooling stop temperature zone of 100° C. to 250° C. at an average cooling rate of 3° C./s or more, heating the resulting steel sheet to 350° C. to 500° C., holding the heated steel sheet at a second soaking temperature in a temperature zone of 350° C. to 500° C. for 30 seconds or longer, and cooling the resulting soaked steel sheet to room temperature.

13. A method of producing a high-yield-ratio, high-strength cold-rolled steel sheet, comprising:

heating a steel slab having the composition according to claim 8 to a temperature of 1150° C. to 1300° C., hot rolling the heated slab at a finishing delivery temperature of 850° C. to 950° C., starting cooling of the hot-rolled steel sheet within 1 second after completion of hot rolling, cooling the hot-rolled steel sheet to 650° C. or lower at a first average cooling rate of 80° C./s or more to conduct first cooling, cooling the resulting steel sheet to a temperature of 550° C. or lower at a second average cooling rate of 5° C./s or more to conduct second cooling, coiling the resulting steel sheet to obtain a hot-rolled steel sheet, pickling the hot-rolled steel sheet, cold rolling the pickled steel sheet, and performing continuous annealing that involves heating the resulting cold-rolled steel sheet to a temperature zone of 820° C. or higher at an average heating rate of 3 to 30° C./s, holding the heated steel sheet at a first soaking temperature of 820° C. or higher for 30 seconds or longer, cooling the resulting soaked steel sheet from the first soaking temperature to a cooling stop temperature zone of 100° C. to 250° C. at an average cooling rate of 3° C./s or more, heating the resulting steel sheet to 350° C. to 500° C., holding the heated steel sheet at a second soaking temperature in a temperature zone of 350° C. to 500° C. for 30 seconds or longer, and cooling the resulting soaked steel sheet to room temperature.

14. A method of producing a high-yield-ratio, high-strength cold-rolled steel sheet, comprising:

heating a steel slab having the composition according to claim 9 to a temperature of 1150° C. to 1300° C., hot rolling the heated slab at a finishing delivery temperature of 850° C. to 950° C., starting cooling of the hot-rolled steel sheet within 1 second after completion of hot rolling, cooling the hot-rolled steel sheet to 650° C. or lower at a first average cooling rate of 80° C./s or more to conduct first cooling, cooling the resulting steel sheet to a temperature of 550° C. or lower at a second average cooling rate of 5° C./s or more to conduct second cooling, coiling the resulting steel sheet to obtain a hot-rolled steel sheet, pickling the hot-rolled steel sheet, cold rolling the pickled steel sheet, and performing continuous annealing that involves heating the resulting cold-rolled steel sheet to a temperature zone of 820° C. or higher at an average heating rate of 3 to 30° C./s, holding the heated steel sheet at a first soaking temperature of 820° C. or higher for 30 seconds or longer, cooling the resulting soaked steel sheet from the first soaking temperature to a cooling stop temperature zone of 100° C. to 250° C. at an average cooling rate of 3° C./s or more, heating the resulting steel sheet to 350° C. to 500° C., holding the heated steel sheet at a second soaking temperature in a temperature zone of 350° C. to 500° C. for 30 seconds or longer, and cooling the resulting soaked steel sheet to room temperature.

15. A method of producing a high-yield-ratio, high-strength cold-rolled steel sheet, comprising:

heating a steel slab having the composition according to claim 10 to a temperature of 1150° C. to 1300° C., hot rolling the heated slab at a finishing delivery temperature of 850° C. to 950° C., starting cooling of the hot-rolled steel sheet within 1 second after completion of hot rolling, cooling the hot-rolled steel sheet to 650° C. or lower at a first average cooling rate of 80° C./s or more to conduct first cooling, cooling the resulting steel sheet to a temperature of 550° C. or lower at a second average cooling rate of 5° C./s or more to conduct second cooling, coiling the resulting steel sheet to obtain a hot-rolled steel sheet, pickling the hot-rolled steel sheet, cold rolling the pickled steel sheet, and performing continuous annealing that involves heating the resulting cold-rolled steel sheet to a temperature zone of 820° C. or higher at an average heating rate of 3 to 30° C./s, holding the heated steel sheet at a first soaking temperature of 820° C. or higher for 30 seconds or longer, cooling the resulting soaked steel sheet from the first soaking temperature to a cooling stop temperature zone of 100° C. to 250° C. at an average cooling rate of 3° C./s or more, heating the resulting steel sheet to 350° C. to 500° C., holding the heated steel sheet at a second soaking temperature in a temperature zone of 350° C. to 500° C. for 30 seconds or longer, and cooling the resulting soaked steel sheet to room temperature.

16. A method of producing a high-yield-ratio, high-strength cold-rolled steel sheet, comprising:

heating a steel slab having the composition according to claim 11 to a temperature of 1150° C. to 1300° C., hot rolling the heated slab at a finishing delivery temperature of 850° C. to 950° C., starting cooling of the hot-rolled steel sheet within 1 second after completion of hot rolling, cooling the hot-rolled steel sheet to 650° C. or lower at a first average cooling rate of 80° C./s or more to conduct first cooling, cooling the resulting steel sheet to a temperature of 550° C. or lower at a second average cooling rate of 5° C./s or more to conduct second cooling, coiling the resulting steel sheet to obtain a hot-rolled steel sheet, pickling the hot-rolled steel sheet, cold rolling the pickled steel sheet, and performing continuous annealing that involves heating the resulting cold-rolled steel sheet to a temperature zone of 820° C. or higher at an average heating rate of 3 to 30° C./s, holding the heated steel sheet at a first soaking temperature of 820° C. or higher for 30 seconds or longer, cooling the resulting soaked steel sheet from the first soaking temperature to a cooling stop temperature zone of 100° C. to 250° C. at an average cooling rate of 3° C./s or more, heating the resulting steel sheet to 350° C. to 500° C., holding the heated steel sheet at a second soaking temperature in a temperature zone of 350° C. to 500° C. for 30 seconds or longer, and cooling the resulting soaked steel sheet to room temperature.

* * * * *